US009087444B2

(12) United States Patent
Egawa et al.

(10) Patent No.: US 9,087,444 B2
(45) Date of Patent: Jul. 21, 2015

(54) ALARM DEVICE

(75) Inventors: Yoshitaka Egawa, Tokyo (JP); Hidenari Matsukuma, Yamato (JP)

(73) Assignee: Hochiki Corporation, Tokyo (JP)

( * ) Notice: Subject to any disclaimer, the term of this patent is extended or adjusted under 35 U.S.C. 154(b) by 137 days.

(21) Appl. No.: 12/922,182

(22) PCT Filed: Nov. 19, 2008

(86) PCT No.: PCT/JP2008/071003

§ 371 (c)(1),
(2), (4) Date: Sep. 13, 2010

(87) PCT Pub. No.: WO2009/116203

PCT Pub. Date: Sep. 24, 2009

(65) Prior Publication Data

US 2011/0018705 A1 Jan. 27, 2011

(30) Foreign Application Priority Data

Mar. 17, 2008 (JP) ..... 2008-067171

(51) Int. Cl.
*G08B 17/00* (2006.01)
*G08B 27/00* (2006.01)
(Continued)

(52) U.S. Cl.
CPC ..... *G08B 27/003* (2013.01); *G08B 17/00* (2013.01); *G08B 17/10* (2013.01);
(Continued)

(58) Field of Classification Search
CPC ..... G08B 17/00; G08B 17/06; G08B 17/10; G08B 17/11; G08B 17/103; G08B 17/107; G08B 25/009; G08B 25/10; G08B 25/003; G08B 7/06; G08B 21/0216; G08B 21/0227; G08B 21/0277; G08B 21/0294
USPC ..... 340/539.1, 539.22, 628, 686.6; 709/201; 700/3
See application file for complete search history.

(56) References Cited

U.S. PATENT DOCUMENTS 3,510,863 A * 5/1970 McBrian ..... 340/529

FOREIGN PATENT DOCUMENTS

JP 61065398 A 4/1986
JP 02014400 A 1/1990
(Continued)

OTHER PUBLICATIONS

Notification (Information Statement) issued in Japanese Patent Application No. 2010-503742, mailed Jan. 31, 2012, 115 pages.
(Continued)

*Primary Examiner* — Daniell L Negron
*Assistant Examiner* — Benyam Haile
(74) *Attorney, Agent, or Firm* — Wood, Herron & Evans, LLP

(57) ABSTRACT

An interlocking source alarm output processing unit outputs alarm indicating an interlocking source and transmits event signal indicating the abnormality to other alarm device. An interlocking destination alarm output processing unit outputs alarm indicating an interlocking destination. An interlocking source alarm stop processing unit transmits the event signal and stops an output of the alarm, upon detecting an operation to an alarm stopping unit while outputting the alarm indicating the interlock source. An interlocking destination alarm stop processing unit stops an output of the alarm indicating the interlocking destination and transmits the event signal for stopping the alarm, when an operation to the alarm stopping unit is detected while outputting the alarm indicating the interlocking destination, while the interlocking destination alarm stop processing unit stops an output of the alarm indicating the interlocking destination, when the event signal from the other alarm device is received.

3 Claims, 11 Drawing Sheets

(51) Int. Cl.

| | |
|---|---|
| ***G08B 17/10*** | (2006.01) |
| ***G08B 25/00*** | (2006.01) |
| ***G08B 25/10*** | (2006.01) |
| *G08B 21/02* | (2006.01) |
| *G08B 17/06* | (2006.01) |

(52) U.S. Cl.

CPC ..... *G08B 21/0227* (2013.01); *G08B 25/001* (2013.01); *G08B 25/007* (2013.01); *G08B 25/009* (2013.01); *G08B 25/10* (2013.01); *G08B 17/06* (2013.01); *G08B 21/0216* (2013.01); *G08B 21/0277* (2013.01); *G08B 21/0294* (2013.01)

(56) References Cited

FOREIGN PATENT DOCUMENTS

| | | | | |
|---|---|---|---|---|
| JP | 04354298 | A | | 12/1992 |
| JP | 07-244786 | A | | 9/1995 |
| JP | 2000-222654 | A | | 8/2000 |
| JP | 2001-143172 | A | | 5/2001 |
| JP | 2002-074535 | | | 3/2002 |
| JP | 2003044955 | A | | 2/2003 |
| JP | 2005-222319 | | | 8/2005 |
| JP | 2005222319 | A | * | 8/2005 |
| JP | 2005292969 | A | | 10/2005 |
| JP | 2006-351048 | A | | 12/2006 |
| JP | 2007047890 | A | | 2/2007 |
| JP | 2007-094719 | | | 4/2007 |
| JP | 2007-128221 | A | | 5/2007 |
| JP | 2007-200084 | A | | 8/2007 |
| JP | 2008009481 | A | | 1/2008 |
| JP | 2008-033428 | | | 2/2008 |
| JP | 2008033428 | A | * | 2/2008 |
| JP | 2009-157952 | A | | 7/2009 |

OTHER PUBLICATIONS

Japanese Patent Office, Search Report in International Patent Application No. PCT/JP2008/071003 dated Jan. 13, 2009.

Office Action issued in Japanese Patent Application No. 2010-503742, mailed Aug. 7, 2012, 4 pages.

Japanese Patent Office, Notice of Allowance issued in Application No. 2009-185565, mailed Jun. 12, 2012, 6 pp.

Japanese Patent Office, Office Action issued in Application No. 2009-062511, mailed Jul. 3, 2012, 4 pp.

Japanese Patent Office, Office Action issued in Application No. 2009-185565, mailed Sep. 6, 2011, 6 pp.

Japanese Patent Office, Office Action issued in Application No. 2011-235863, mailed Feb. 5, 2013, 6 pp.

* cited by examiner

ALARM DEVICE

TECHNICAL FIELD

The present invention relates to an alarm device which detects and warns of an abnormal condition, such as a fire, and transmits signals to other alarm device for interlocking alarm output.

Priority is claimed on Japanese Patent Application No. 2008-67171, the contents of which are incorporated herein by reference.

BACKGROUND ART

Related art alarm devices known as home alarm devices have a function to detect abnormal conditions, such as a fire and gas leak, in the home and warn of the abnormal conditions with sound or other means. Recent homes have two or more alarm devices installed therein to monitor the occurrence of abnormal conditions, such as a fire, in each room.

In such a home with two or more alarm devices installed therein, a user in a room other than the room where an abnormal condition is occurring sometimes cannot hear alarm sound. As a result, a disaster, such as a fire, may spread. Consequently, there is proposed in which the alarm devices is connected in cable mutually when one of the hard-wired alarm devices detects fire, that alarm device transmits signals to others to make them simultaneously output an alarm sound, thereby implementing a interlocking alarm (see, for example, the following Patent Document 1).

However, hard-wired alarm devices require wiring works and are thus costly. This problem can be solved by adopting wireless alarm devices. Since the latest ICs for radio circuits have reduced in power consumption, the alarm devices are guaranteed with longer, e.g., over five years, practical battery life even if the alarm devices are always ready for receiving signals from other alarm devices in order to enable reception of signals from other alarm devices. Thus, an environment for practical wireless alarm devices is being completed.

In the related art alarm systems, when one of the two or more hard-wired alarm devices detects a fire, the alarm device which detected fire, i.e., a interlocking source, sounds an alarm different from that output from other alarm devices which received a fire signal, i.e., interlocking destinations. For example, the interlocking source alarm device which detected fire continually outputs a voice message "(sound of siren) Fire alarm device was activated. Check it out." On the contrary, the interlocking destination alarm device continually output a voice message "(sound of siren) Another alarm device was activated. Check it out." A red light of the interlocking source alarm device is flashing while red light of the interlocking destination alarm device is blinking. This means that a user can distinguish the interlocking source alarm device from the interlocking destination alarm device by confirming indication of the red light.

An alarm device includes an alarm stop switch which is also used as a check switch. When a switch is operated with, for example, a pulling string while the alarm device is outputting an alarm, output of the alarm can be stopped. In the hard-wired alarm devices, when the alarm stop switch of the interlocking source alarm device which detected fire is operated, the alarm sound output from all the alarm devices stops. When the alarm stop switch of the interlocking destination alarm device is operated, the alarm sound of that alarm device stops.

When the output of alarm from the interlocking source alarm device is stopped, if, for example, smoke, which indicates a fire, remains all the alarm devices output alarms again after a predetermined period of time elapsed.

[Patent Document 1] Japanese Unexamined Patent Application, First Publication No. 2007-094719

DISCLOSURE OF THE INVENTION

Problems to be Solved by the Invention

Regarding checking of the place of the interlocking source alarm device at which fire occurs, a person who wants to stop the output of coupled alarm of the related art alarm devices would have to walk through the rooms to stop the alarm sound of the interlocking destination alarm device until the interlocking source alarm device is specified. It is sometimes possible that time and effort would be taken to identify the interlocking source alarm device.

In response to the interlocking alarm, a user may want to stop the alarm sound first and then find the place of fire without being bothered by the alarm sound. In this case, there is also a problem that, since the operation of sopping the alarm takes time and effort, a user must find the place of fire in the midst of a loud, interlocking output alarm sound.

The invention was made with respect to the above-described problems, it is an object of the present invention to provide a wireless alarm device with which a place of fire can be specified easily by a operation of stopping the output of interlocking and sending alarms.

Means for Solving the Problems

The invention adopts the following in order to solve the above problems.

(System to Stop Alarm Sound at Interlocking Source)

That is, (1) an alarm device of the invention includes: a transmitting-and-receiving circuit unit which transmits and receives an event signal with other alarm device; an alarming unit which outputs alarm; an operating unit which includes an alarm stopping unit; an interlocking source alarm output processing unit which, upon receiving abnormal-detection signal from a sensor unit which detects abnormality, outputs alarm indicating an interlocking source, and transmits the event signal indicating the abnormality to the other alarm device of an interlocking destination; an interlocking destination alarm output processing unit which, upon receiving event signal indicating the abnormality from the other alarm device, outputs alarm indicating an interlocking destination; an interlocking source alarm stop processing unit which, upon detecting an operation to the alarm stopping unit while outputting the alarm indicating the interlock source, transmits the event signal for stopping the alarm to the other alarm device and stops the alarm; and an interlocking destination alarm stop processing unit which stops an output of the alarm indicating the interlocking destination and transmits the event signal for stopping the alarm to the other alarm device, when an operation to the alarm stopping unit is detected while outputting the alarm indicating the interlocking destination, while which stops an output of the alarm indicating the interlocking destination, when the event signal for stopping the alarm from the other alarm device is received, while outputting the alarm indicating the interlocking destination.

(System to Stop Alarm Sound Simultaneously)

(2) Another alarm devices of the invention include: a transmitting-and-receiving circuit unit which transmits and receives an event signal with other alarm device;

an alarming unit which outputs alarm; an operating unit which includes an alarm stopping unit; an interlocking source alarm output processing unit which, upon receiving abnormal-detection signal from a sensor unit which detects abnormality, outputs alarm indicating an interlocking source, and transmits the event signal indicating the abnormality to the other alarm device of an interlocking destination; an interlocking destination alarm output processing unit which, upon receiving event signal indicating the abnormality from the other alarm device, outputs alarm indicating an interlocking destination; an interlocking source alarm stop processing unit which, upon detecting an operation to the alarm stopping unit, while outputting the alarm indicating the interlocking source, stops an output of the alarm indicating the interlocking source, generates the event signal for stopping the alarm and transmits to the other alarm device, while which, upon receiving event signal for stopping the alarm from the other alarm device, while outputting the alarm indicating the interlocking source, stops an output of the alarm indicating the interlocking source; and an interlocking destination alarm stop processing unit which stops an output of the alarm indicating the interlocking destination and transmits the event signal for stopping the alarm to the other alarm device, when an operation to the alarm stopping unit is detected while outputting the alarm indicating the interlocking destination, while which stops an output of the alarm indicating the interlocking destination, when the event signal for stopping the alarm from the other alarm device is received, while outputting the alarm indicating the interlocking destination.

(3) In the alarm device described in the above (2), it may be arranged such that: the interlocking source alarm output processing unit outputs a display of alarm together with alarm sound indicating the interlocking source; and the interlocking source alarm stop processing unit maintains the display of alarm without stopping the display of alarm when the output of the alarm sound indicating the interlocking source is stopped.

(Switching System)

(4) Another alarm devices of the invention include: a transmitting-and-receiving circuit unit which transmits and receives an event signal with other alarm devices; an alarming unit which outputs alarm; an operating unit which includes an alarm stopping unit; an interlocking source alarm output processing unit which, upon receiving abnormal-detection signal from a sensor unit which detects abnormality, outputs alarm indicating an interlocking source, and transmits the event signal indicating the abnormality to the other alarm device of an interlocking destination; an interlocking destination alarm output processing unit which, upon receiving event signal indicating the abnormality from the other alarm device, outputs alarm indicating an interlocking destination; a mode switching unit which switches an alarm stopping mode either a first mode or a second mode; an interlocking source alarm stop processing unit which, upon receiving the event signal for stopping the alarm from the other alarm device while outputting the alarm indicating the interlocking source in the first mode, maintains outputting the alarm, while which stops an output of the alarm indicating the interlocking source, when the event signal for stopping the alarm from the other alarm device is received while outputting the alarm indicating the interlocking source in the second mode; an interlocking destination alarm stop processing unit which stops an output of the alarm indicating the interlocking destination and transmits the event signal for stopping the alarm to the other alarm device, when an operation to the alarm stopping unit is detected while outputting the alarm indicating the interlocking destination in the first mode or the second mode, while which stops an output of the alarm indicating the interlocking destination, when the event signal for stopping the alarm from the other alarm device is received, while outputting the alarm indicating the interlocking destination in the first mode or the second mode.

(5) In the alarm device described in the above (4), it may be arranged such that: the interlocking source alarm output processing unit outputs a display of alarm together with alarm indicating the interlocking source; and the interlocking source alarm stop processing unit maintains the display of alarm more than a predetermined period of time at least without stopping display of alarm when the output of the alarm indicating the interlocking source is stopped in the second mode.

(6) In the alarm device described in any one of (1) to (5), it may be arranged such that: when abnormal-detection signal from the sensor unit is received while outputting the alarm indicating the interlocking destination, the interlocking destination alarm stop processing unit stops an output of the alarm; and the interlocking source alarm output processing unit outputs alarm indicating an interlocking source and transmits the event signal indicating the abnormality to the other alarm device of an interlocking destination.

Effect of the Invention (System to Stop Alarm Sound at Interlocking Source)

According to the alarm device of the invention, when interlocking alarm is issued and an alarm stop processing is performed at any one of the alarm devices which are outputting the alarm sound regardless of being interlocking destination or interlocking source, the alarm sound of all the alarm devices is stopped if the alarm devices which is performed the stop processing at the interlocking source and the alarm sound of the particular alarm device is stopped if the alarm devices which is performed the stop processing at the interlocking destination. Alarm stop event signals are transmitted to other alarm devices to stop the alarm sound if the other alarm devices are interlocking destinations whereas alarm sound is not stopped if the other alarm devices are also interlocking sources.

That is, only the interlocking source alarm device among the two or more alarm devices outputting interlocking alarm can stop the alarm sound of all the alarm devices simultaneously in response to the alarm stop processing. Other interlocking destination alarm device can stop the alarm sound of self and other interlocking destination alarm devices, but not stop the alarm sound of the interlocking source alarm device. Accordingly, unless a stop processing of the alarm sound is performed at the interlocking source alarm device, the alarm sound of the interlocking source alarm device is continuously output.

On the contrary, when a stop processing of the alarm sound of any of the interlocking destination alarm devices is performed, the alarm sound of other interlocking destination alarm devices is also stopped and only the alarm sound of the interlocking source alarm device is continuously output. Thus, the interlocking source alarm device, i.e., the place where an abnormal condition, such as a fire, occurs can be rapidly and specified easily.

(System to Stop Alarm Sound Simultaneously)

According to the alarm device of the invention with this configuration, when interlocking alarm is issued and an alarm stop processing is performed at any one of the alarm devices which are outputting the alarm sound regardless of being interlocking destination or interlocking source, the alarm sound of the alarm device at which the stop processing is performed is stopped and, at the same time, alarm stop event signals are transmitted to other alarm devices and the alarm sound is stopped. As a result, the alarm sound of all the alarm devices outputting interlocking alarm can be stopped simultaneously by the alarm stop processing in any of the alarm devices. Further, interlocking alarm can be stopped simultaneously with a simple operation and thus a user can rapidly confirm the place where the abnormal condition, such as a fire, occurs without being bothered by a loud the alarm sound. Especially in a case in which interlocking alarm is made as a so called non-fire report, in which the alarm devices sound alarms in response to, for example, smoke rather than fire, alarm stop can be performed simply and easily and thus the devices become more useful.

(Switching System)

According to the alarm device of the invention with this configuration, the user can choose to stop the alarm sound of all the interlocking destination alarm devices but allowing the alarm sound of the interlocking source to continuously sound, or to make all the alarm sounds stop simultaneously by switching the alarm stop modes. Thus, the user can perform an appropriate operation in accordance with situations in which the alarm devices are used.

REFERENCE NUMERALS

Figure 1B:
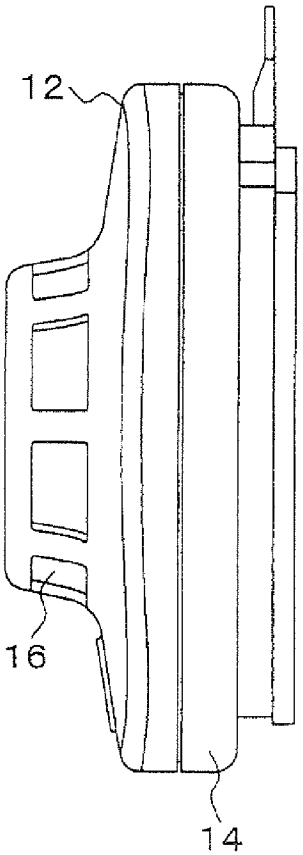
FIG. 1B is a side view of the alarm device.

10, 10-1 to 10-5: alarm devices
12: cover
14: main body
15: attachment hook
16: smoke detector
18: sound hole
20: alarm stop switch
22: LED
24: home
26: garage
28: CPU
31: antenna
30: wireless circuit unit
32: recording circuit unit
34: sensor unit
36: alarming unit
38: operating unit
40: battery power supply
42: transmission circuit
44: reception circuit
46: memory
48: event signal
50: transmitter code
52: group code
54: event code
58: speaker
60: interlocking source alarm output processing unit
62: interlocking destination alarm output processing unit
64, 164, 264: interlocking source alarm stop processing unit
66, 266: interlocking destination alarm stop processing unit
70: mode switching unit

BEST MODE FOR IMPLEMENTING THE INVENTION

Figure 1A:
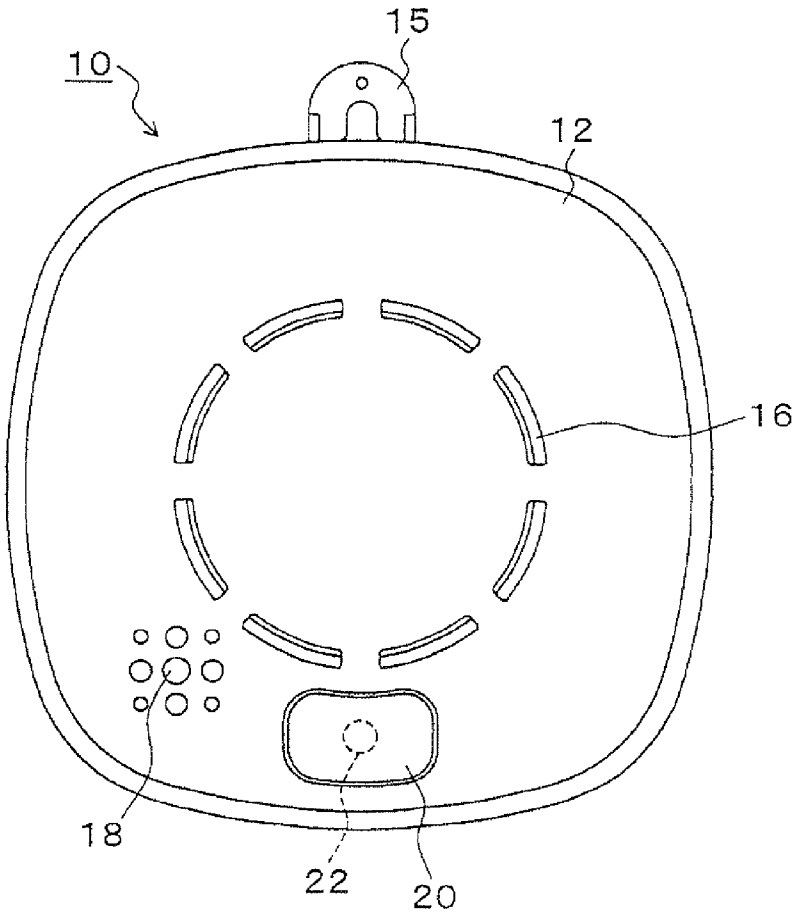
FIG. 1A is a front view illustrating the exterior of an alarm device according to an embodiment of the invention.

FIGS. 1A and 1B illustrate the exterior of a wireless alarm device according to the invention. FIG. 1A is a front view and FIG. 1B is a side view.

As shown in FIGS. 1A and 1B, an alarm device 10 of the present embodiment is configured by a cover 12 and a main body 14. A smoke detector 16 is provided at the center of the cover 12. The smoke detector 16 has a smoke entrance disposed to surround the same. The smoke detector 16 detects fire when smoke density reaches a predetermined density.

A sound hole 18 is provided at a lower left side of the smoke detector 16 provided in the cover 12. A speaker is provided behind the sound hole 18 and outputs the alarm sound and voice message. An alarm stop switch 20 is provided below the smoke detector 16. The alarm stop switch 20 is also used as a cheek switch.

An LED 22 is provided inside the alarm stop switch 20 as shown with a dotted line. When the LED 22 is turned on, a lighting status of the LED 22 is recognized from outside through a switch cover portion of the alarm stop switch 20.

An attachment hook 15 is provided in an upper portion of a back side of the main body 14. Screws or other members may be fixed to the wall of a room where the alarm device 10 is to be installed and the alarm device 10 may be attached to the screws. Thus, the alarm device 10 can be installed on a surface of the wall.

The alarm device 10 shown in FIGS. 1A and 1B is as an example alarm device provided with the smoke detector 16 for detecting fire smoke. However, other alarm devices, such as those provided with a thermistor for detecting fire heat or those for detecting gas leak in addition to fire may also be included in the invention.

Figure 2:
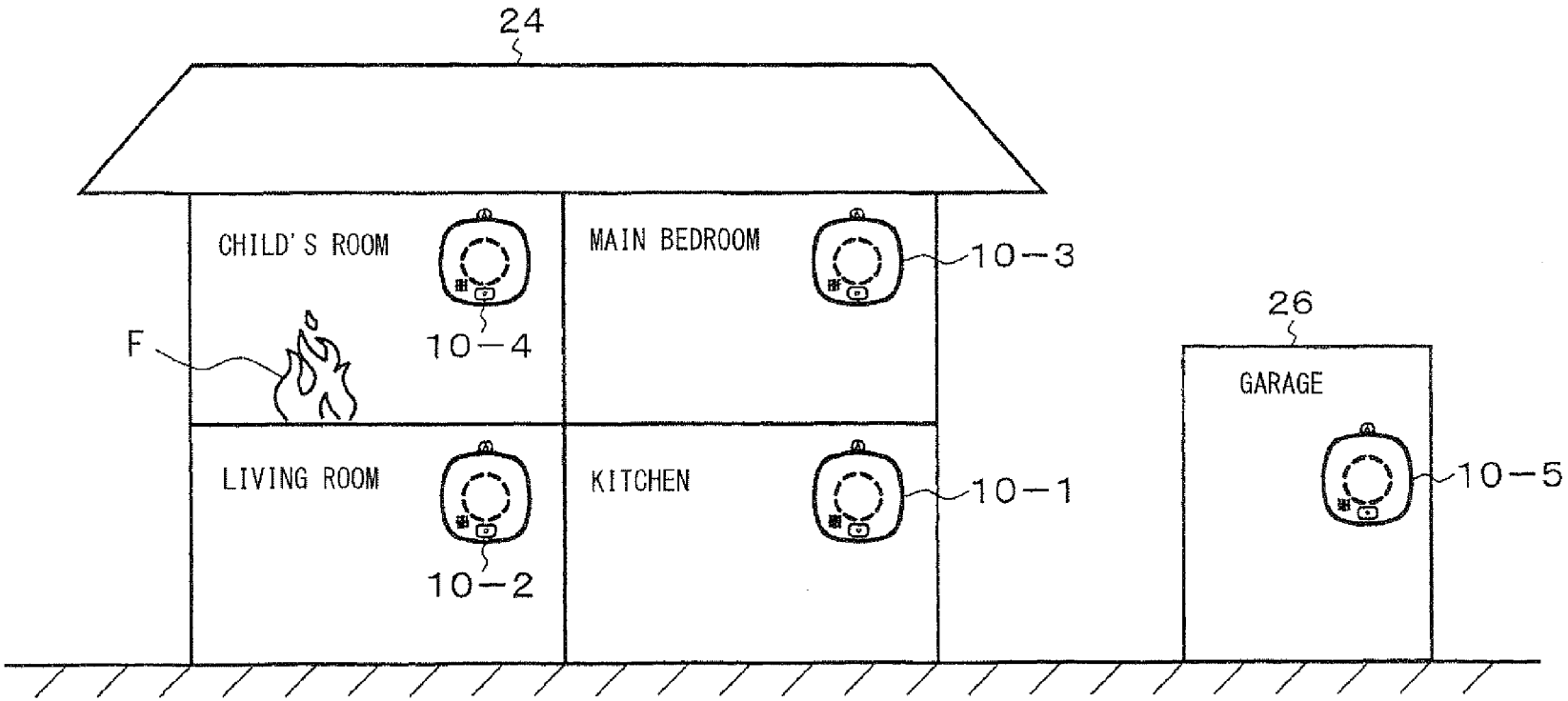
FIG. 2 is an explanatory view illustrating a state in which the alarm device is installed in a home.

FIG. 2 is an explanatory view illustrating a state in which the alarm device is installed in a home. As shown in FIG. 2, alarm devices 10-1 to 10-4 of the present embodiment are installed in each of kitchen, living room, main bedroom and child's room of a home 24. In addition, an alarm device 10-5 is installed in an outside garage 26. Reference numeral Fin FIG. 2 represents a fire.

Each of the alarm devices 10-1 to 10-5 has a function to transmit and receive event signals to and from one another wirelessly. The five alarm devices 10-1 to 10-5 constitute a group for monitoring the entire home.

When fire breaks out in the child's room of the home 24, the alarm device 10-4 detects fire and starts an output of an alarm. To start outputting an alarm upon detection of fire is called "alerting" in the alarm device. When the alarm device 10-4 starts alerting, the alarm device 10-4 operates as an interlocking source and wirelessly transmits event signals indicating fire alert to other alarm devices 10-1 to 10-3 and 10-5 which are operating as interlocking destinations. Upon reception of the event signals indicating fire alert from the interlocking source alarm device 10-4, other alarm devices 10-1 to 10-3 and 10-5 perform alarming operations as interlocking destinations.

The interlocking source alarm device 10-4 continually outputs the alarm sound, such as a voice message "(sound of siren) The alarm device is activated. Check it out." The interlocking destination alarm devices 10-1 to 10-3 and 10-5 continually output, for example, a voice message "(sound of siren) Another alarm device is activated. Check it out."

When the alarm stop switch 20 provided in the alarm device 10 shown in FIGS. 1A and 1B is operated while the alarm devices 10-1 to 10-5 are still outputting the alarm sound, a stop processing of the alarm sound is performed.

As an operation to stop the alarm sound in the present embodiment, any of the following stop processings is performed as stop processing of the alarm sound.

(1) When the alarm stop switch 20 of any of the alarm devices 10-1 to 10-5 is pressed, only the interlocking source alarm device 10-4 continues outputting the alarm sound and the interlocking destination alarm devices 10-1 to 10-3 and 10-5 stop the alarm sound (a first embodiment).

(2) When the alarm stop switch 20 of any of the alarm devices 10-1 to 10-5 outputting the alarm is pressed, all the alarm devices 10-1 to 10-5 stop outputting the alarm sound regardless of being interlocking destination or interlocking source (a second embodiment).

Figure 3:
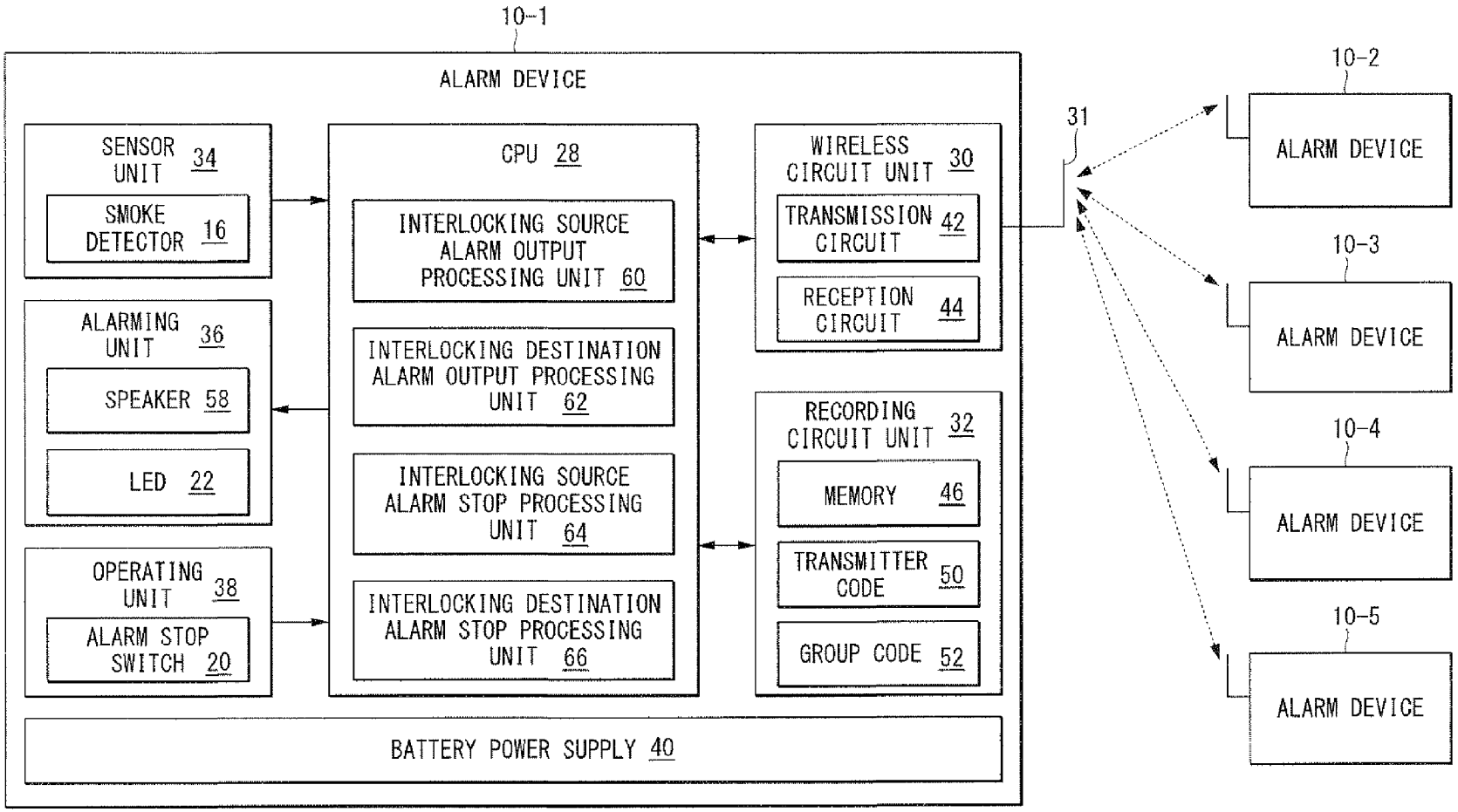
FIG. 3 is a block diagram illustrating a first embodiment of the alarm device.

(3) The alarm is stop selectively between a first mode of the alarm stop process of the above (1) and a second mode of the alarm stop process of above (2) (a third embodiment), FIG. 3 is a block diagram of the first embodiment of the alarm device according to the invention. FIG. 3 shows a circuit configuration in detail about the alarm device 10-1 among the five alarm devices 10-1 to 10-5 shown in FIG. 2.

The alarm device 10-1 includes a CPU 28. A wireless circuit unit 30 provided with an antenna 31, a recording circuit unit 32, sensor unit 34, an alarming unit 36 and an operating unit 38 are provided to be communicative with the CPU 28. The alarm device 10-1 includes a battery power supply 40.

The wireless circuit unit 30 includes a transmission circuit 42 and a reception circuit 44 and thus can transmit and receive event signals wirelessly among other alarm devices 10-2 to 10-5. For use in Japan, the wireless circuit unit 30 has a configuration based on standards, such as STD-30 (standards for radio equipment of a radio station of small power security systems) known as a standard for 400 MHz-band specific small power radio station or STD-T67 (a standard for specific small power radio station telemeters, for telecontrol and for radio equipment for data communication).

Note that the wireless circuit unit 30 may be configured to conform standards of allocated radio stations of areas outside Japan.

The recording circuit unit 32 includes memory 46. The memory 46 stores a transmitter code 50 used as an identifier (ID) for specifying the alarm device, and a group code 52 for constituting a group which performs interlocking alarm by two or more alarm devices as shown in FIG. 2. As the transmitter code 50, for example, a 26-bit code is used so as not to overlap the codes on an estimation of the number of alarm devices provided for domestic use.

The group code 52 is a code commonly assigned to two or more alarm devices which constitute a interlocking group. When a group code included in the event signals output by other alarm devices received by the wireless circuit unit 30 is in agreement with the group code 52 registered in the memory 46, the event signals will be received and processed as valid signals.

Although the memory 46 is used in the recording circuit unit 32 in the present embodiment, a dip switch may be provided instead of the memory 46 and with which the transmitter code 50 and the group code 52 may be set. If the code length (i.e., number of bits) of the transmitter code 50 or the group code 52 is small, the recording circuit unit 32 using the dip switch is preferred.

In the present embodiment, the sensor unit 34 includes a smoke detector 16 for detecting smoke. In addition to the smoke detector 16, a thermistor for detecting a temperature due to a fire may be provided in the sensor unit 34. A gas leak sensor is provided at the sensor unit 34 when the alarm device is used for monitoring gas leaks.

The alarming unit 36 includes a speaker 58 and the LED 22. The speaker 58 outputs voice message and the alarm sound from a voice synthesis circuit unit, which is not shown. The LED 22 indicates abnormality, such as a fire, by flashing, blinking, lighting and other means.

The operating unit 38 includes the alarm stop switch 20. When the alarm stop switch 20 is operated, the alarm sound being output from the alarm device 10-1 can be stopped. The alarm stop switch 20 functions also as check switch in the present embodiment. The alarm stop switch 20 becomes effective when the alarming unit 36 is outputting the alarm sound through the speaker 58. In a normal monitoring state in which alarm sound is not output, the alarm stop switch 20 functions as a check switch. When the check switch is pressed, a voice message or other sound for checking is output from the alarming unit 36.

The battery power supply 40 employs, for example, an alkaline dry cell with predetermined number of cells. Regarding capacity of the battery, since the entire circuit unit including the wireless circuit unit 30 in the alarm device 10-1 has lowered power consumption, battery life for about ten years is guaranteed.

As functions implemented through execution of programs, the CPU 28 includes a interlocking source alarm output processing unit 60, a interlocking destination alarm output processing unit 62, a interlocking source alarm stop processing unit 64 and a interlocking destination alarm stop processing unit 66.

When fire is detected by the smoke detector 16 provided in the sensor unit 34, the interlocking source alarm output processing unit 60 repeatedly outputs the alarm sound indicating the interlocking source, like "(sound of siren) The alarm device was activated. Check it out." from the speaker 58 of the alarming unit 36. At the same time, the interlocking source alarm output processing unit 60 transmits event signals indicating a fire alert from the antenna 31 to other alarm devices 10-2 to 10-5 by the transmission circuit 42 of the wireless circuit unit 30.

Upon receiving of an event signal indicating a fire alert from any of the other alarm devices 10-2 to 10-5 with the reception circuit 44 of the wireless circuit unit 30, the interlocking destination alarm output processing unit 62 repeatedly outputs alarm sound indicating the interlocking destination, such as a voice message "(sound of siren) Another alarm device was activated. Check it out." from the speaker 58 of the alarming unit 36.

Here, when the interlocking source alarm output processing unit 60 detects fire alert and outputs an alarm sound of the interlocking source, the LED 22 of the alarming unit 36 is made to flash, for example. On the contrary, when the interlocking destination alarm output processing unit 62 outputs the alarm sound of the interlocking destination, the LED 22 of the alarming unit 36 is made to blink. In this manner, display of the LED 22 for in the alarm of the interlocking source and the alarm of the interlocking destination can be distinguished. Of course, same display of the LED 22, i.e., flashing or blinking, may be employed for both the alarm of the interlocking source and the alarm of the interlocking destination.

The interlocking source alarm stop processing unit 64, upon detecting an operation of the alarm stop switch 20 provided with the operating unit 38 while outputting the alarm sound indicating the interlocking source, stops the alarm indicating the interlocking source outputting from the speaker 58 and transmits event signals for stopping the alarm from the transmission circuit 42 of the wireless circuit unit 30 to other alarm devices 10-2 to 10-5, stops the alarm sound indicating the interlocking destination in other alarm devices 10-2 to 10-5.

The interlocking destination alarm stop processing unit 66, upon detecting the operation to the alarm stop switch 20 provided with the operating unit 38 while outputting the alarm sound indicating the interlocking destination, stops the alarm sound indicating the interlocking destination outputting from the speaker 58 and transmits event signals for stopping the alarm from the transmission circuit 42 of the wireless circuit unit 30 to other alarm devices 10-2 to 10-5.

The reception circuit 44 of the wireless circuit unit 30 receives, when the reception circuit 44 of the wireless circuit unit 30 receives event signals for stopping the alarm from other alarm devices 10-2 to 10-5 while outputting the alarm sound indicating the interlocking destination, stops the alarm indicating the interlocking destination. Circuit units similar to those provided in the alarm device 10-1 are also provided in other alarm devices 10-2 to 10-5. The transmitter code 50 stored in the memory 46 is used as a code inherent to each alarm device.

Figure 4:
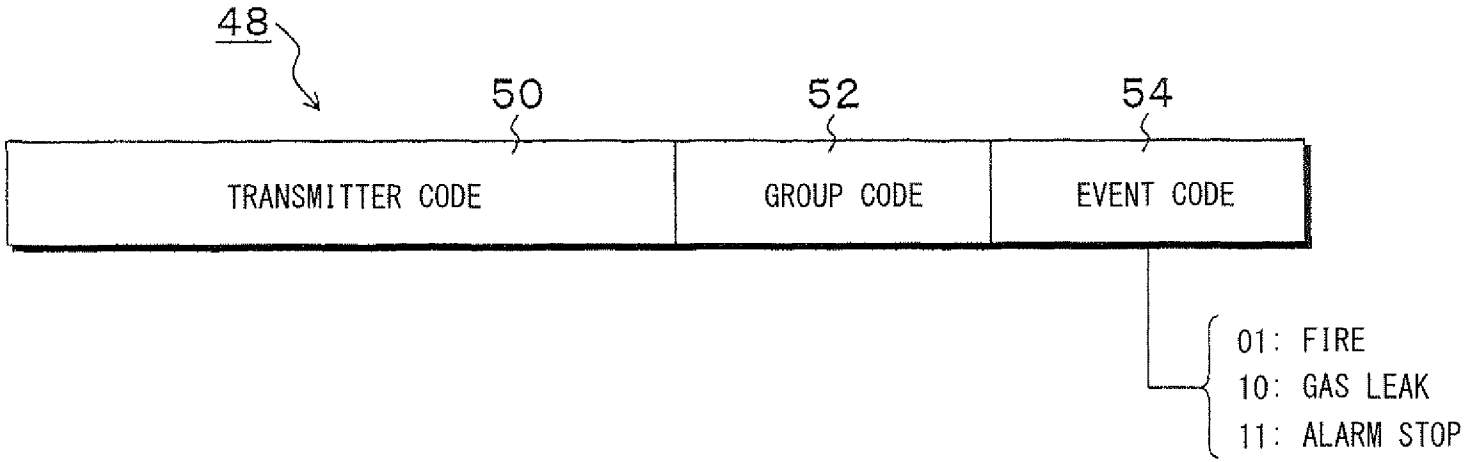
FIG. 4 is an explanatory view illustrating a foul at of an event signal used in the embodiment.

FIG. 4 is an explanatory view illustrating a format of an event signal used in the embodiment. In FIG. 4, an event signal 48 is configured by the transmitter code 50, the group code 52 and the event code 54. The transmitter code 50 is, for example, a 26-bit code. The group code 52 is, for example, an 8-bit code. The same group code is given to the five alarm devices 10-1 to 10-5 shown in FIG. 3 which constitute a single group.

The group code 52 may be a single group code given to the alarm devices constituting a single group, or may be different group codes given to each of the alarm devices. The different group codes is obtained through calculation of a predetermined reference code common to the alarm devices constituting a group and a transmitter code inherent to each alarm device.

The event code 54 represents content of an event, such as a fire and a gas leak, and is a 2-bit code in the present embodiment. For example, "01" indicates a fire, "10" indicates a gas leak and "11" signals alarm stop. The number of bits of the event code 54 may be increased to three or four so that two or more contents of event can be represented.

Figure 5:
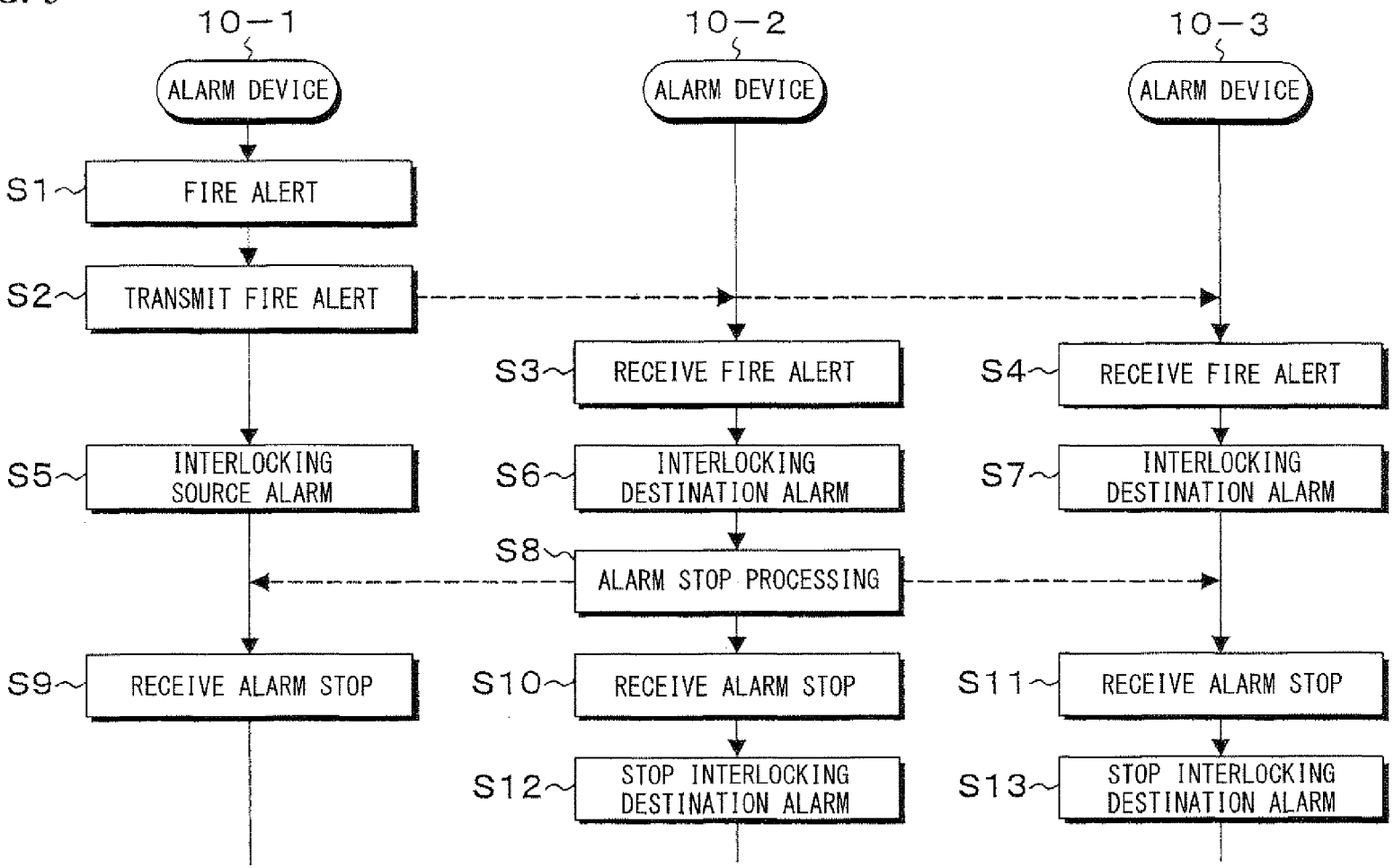
FIG. 5 is a time chart illustrating interlocking alarm and alarm stop according to the embodiment.

FIG. 5 is a time chart indicating interlocking alarm and alarm stop shown in FIG. 3 according to the first embodiment. The time chart illustrates exemplary three alarm devices 10-1 to 10-3 shown FIG. 2.

In FIG. 5, if a fire is detected in the alarm device 10-1 and fire alert sound in step S1, an event signal indicating fire alert is wirelessly transmitted to the alarm devices 10-2 and 10-3 provided in a communication area in step S2.

The alarm devices 10-2 and 10-3 each receive the event signal output from the alarm device 10-1. As shown in FIG. 4, the event signal includes the group code 52. Since the group code 52 is in agreement with those specified in the memory of the alarm devices 10-2 and 10-3, for example, the event signal is received as a valid signal due to such coincidence of the group codes. Fire alert is then received from the event code 54 in steps S3 and S4.

The alarm device 10-1 which detected fire and transmitted the event signal then continually outputs the alarm sound indicating the interlocking source, such as a voice message "(sound of siren) The alarm device is activated. Check it out." in step S5. On the contrary, the alarm device 10-2 and 10-3 continually output the alarm sound indicating the interlocking destination, such as a voice message "(sound of siren) Another alarm device is activated. Check it out." in steps S6 and S7, respectively.

If an operation of the alarm stop switch 20 is detected in step S8 in, for example, the alarm device 10-2 which is the interlocking destination while the interlocking source alarm or interlocking destination alarm is detected in such alarm devices 10-1 to 10-3, an event signal indicating alarm stop is transmitted to other alarm devices 10-1 and 10-3 in step S10.

The alarm device 10-3 determines that the event signal is a valid signal based on the group code of the event signal, recognizes that the event signal represents alarm stop based on the content of the event and receives alarm stop in step S11. Thus, the alarm device 10-3 stops the alarm indicating the interlocking destination in step S13.

On the contrary, the interlocking source alarm device 10-1 determines that the event signal is a valid signal on the basis of the group code of the event signal, recognizes that the event signal indicates alarm stop on the basis of the content of the event and receives alarm stop in step S9. However, even if the alarm device 10-1 recognizes alarm stop in step S9, the alarm indicating the interlocking source is not stopped in step S5 and the alarm sound indicating the interlocking source is continually output. Accordingly, since only the alarm sound of the interlocking source alarm device 10-1 among the alarm devices 10-1 to 10-3 is being output, the place of fire can be determined easily from the alarm sound indicating the interlocking source.

In the example shown in FIG. 5, the alarm stop processing is performed by the interlocking destination alarm device 10-2. However, if the alarm stop processing is performed by the interlocking destination alarm device 10-3, only the interlocking source alarm device 10-1 outputs the alarm sound similarly.

Thus, if there is a user in a place where the alarm device 10-2 or 10-3 is installed, the user can stop the alarm by only operating the alarm stop switch of the alarm device installed in that place when the alarm represents the interlocking destination. As a result, a state is obtained in which only the alarm sound indicating the interlocking source is being output by the alarm device 10-1 in another room. In this manner, the place of fire can be easily found even from other room by the alarm sound of the interlocking source.

Note that if a user wants to stop the alarm sound of the interlocking source alarm device 10-1 and when found by confirmation of the site if it is not a fire, the alarm sound of the interlocking source stops automatically by the user blowing in from a smoke entrance of the smoke detector 16 to purge the smoke. Thus, the alarm device 10-1 returns to its monitoring state.

If smoke remains in the interlocking source alarm device 10-1 and the alarm devices are still in their fire detection states even after the alarm sound is stopped in the interlocking destination alarm device 10-3 in response to the alarm stop processing in step S8, alarms indicating the interlocking destinations will be output again from the interlocking destination alarm devices 10-2 and 10-3 when the event signal indicating fire alert is transmitted after a standardized period of time. The standardized period of time herein does not exceed 15 minutes, for example, 14 minutes, since the event signal indicating alarm stop was transmitted.

Figure 6:
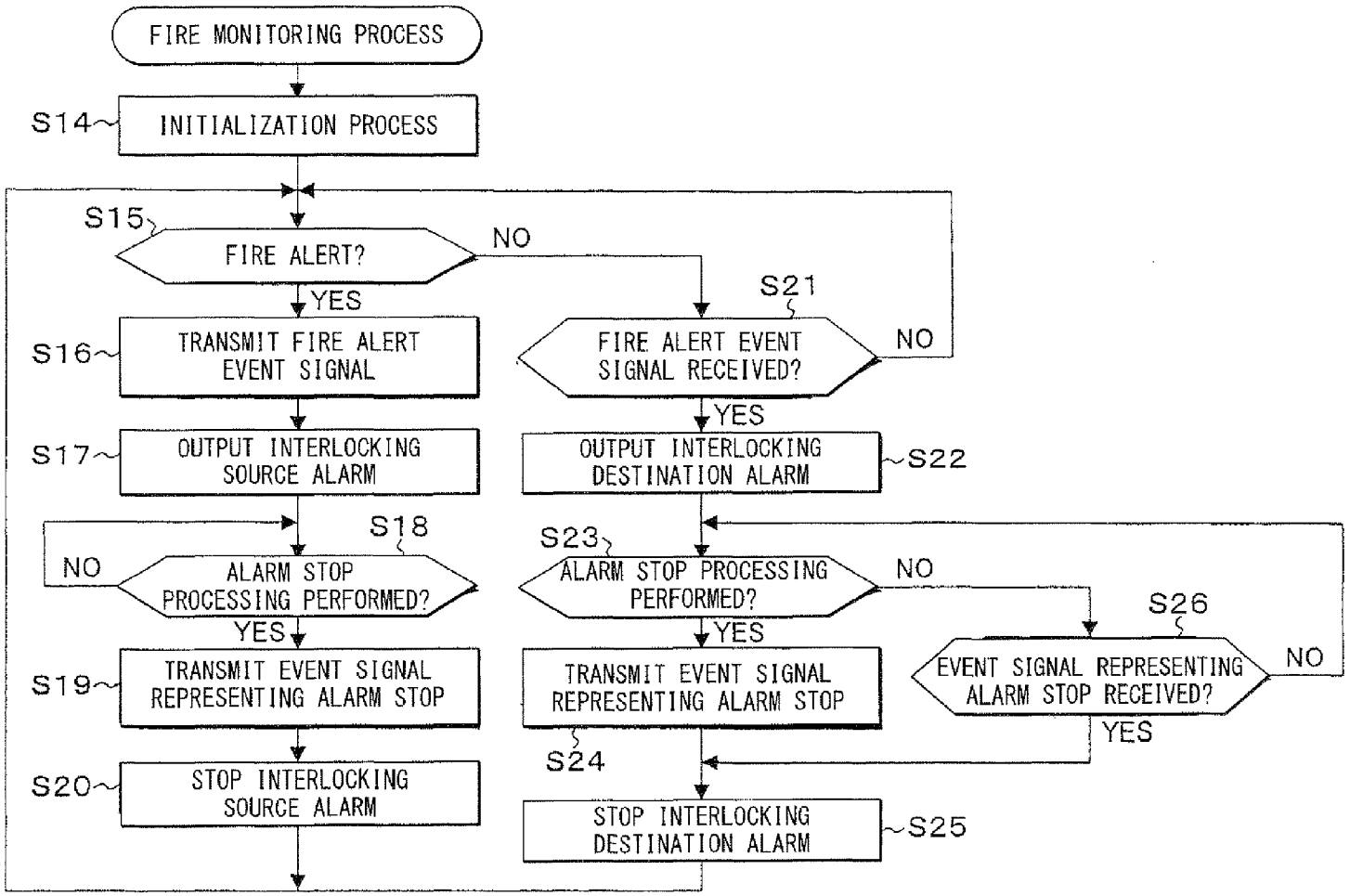
FIG. 6 is a flowchart illustrating a fire monitoring process according to the embodiment.

FIG. 6 is a flowchart illustrating a fire monitoring process according to the first embodiment of FIG. 3. The fire monitoring process is executed by the program of the CPU 28 of FIG. 3.

In FIG. 6, initialization process of the fire monitoring process is executed in step S14. The initialization process includes, for example, setting of a group code for forming a group constituted by five alarm devices 10-1 to 10-5 installed in a single home.

Next, in step S15, existence of fire alert is being monitored. When fire alert is detected, the process proceeds to step S16 where an event signal indicating fire alert is transmitted to other alarm devices wirelessly. Next, an alert indicating interlocking source is output in step S17. Next, in step S18, it is determined whether an alarm stop processing with the alarm stop switch has been made. When the alarm stop processing is detected, an event signal indicating alarm stop is transmitted to other alarm devices in step S19. Then, an alarm indicating the interlocking source is stopped in step S20. If any event signal indicating alarm stop is received from other alarm devices during detection in step S18, the received event signal will be ignored.

On the contrary, if fire alert is not detected in step S15, it is determined whether any event signal indicating fire alert has been received from other alarm devices in step S21. If it is determined that the event signal indicating fire alert has been received from other alarm devices, the process proceeds to step S22 where an alarm indicating the interlocking destination is output. If it is determined that the alarm stop processing has been performed with the alarm stop switch in step S23, an event signal indicating alarm stop is transmitted to other alarm devices in step S24. Then, an alarm indicating the interlocking destination is stopped in step S25.

On the contrary, when the alarm stop processing is not distinguished in step S23, reception of the event signal indicating alarm stop from other alarm devices is checked in step S26. When reception of the event signal indicating alarm stop is distinguished, the alarm indicating interlocking destination is stopped in step S25.

Figure 7:
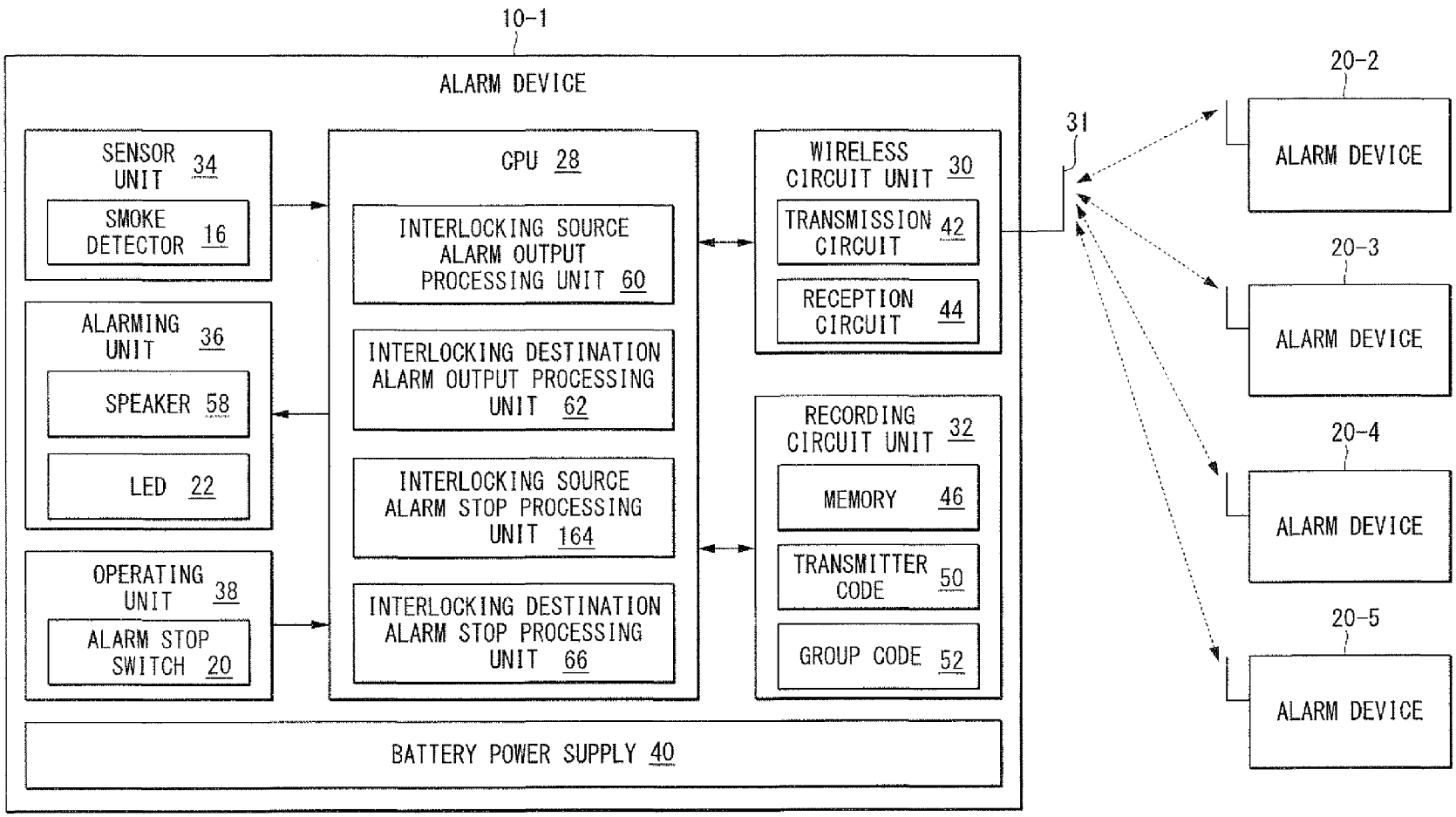
FIG. 7 is a block diagram of a second embodiment of an alarm device according to the invention.

FIG. 7 is a block diagram illustrating a second embodiment of the alarm device according to the invention. The second embodiment is characterized in that, when an alarm stop processing is performed in any of alarm devices while outputting interlocking alarm, all the alarm output is stopped simultaneously.

In FIG. 7, an alarm device 10-1 of which circuit configuration is shown in detail is substantially the same as that in the first embodiment of FIG. 3. The alarm device 10-1 includes a CPU 28, a wireless circuit unit 30, a recording circuit unit 32, a sensor unit 34, an alarming unit 36, an operating unit 38 and a battery power supply 40.

The CPU 28 includes a interlocking source alarm output processing unit 60, a interlocking destination alarm output processing unit 62 and a interlocking destination alarm stop processing unit 66 which are the same functions as those of the first embodiment of FIG. 3. The CPU 28 also includes a interlocking source alarm stop processing unit 164 as a function inherent to the second embodiment.

The inherent interlocking source alarm stop processing unit 164, upon detecting an operation to the alarm stop switch 20 provided with the operating unit 38 while outputting the alarm sound indicating the interlocking source from the speaker 58 of an alarming unit 36, stops the alarm sound indicating the interlocking source and transmits event signals for stopping the alarm to other devices. More, the interlocking source alarm stop processing unit 164, while outputting the alarm sound indicating the interlocking source, upon receiving event signals for stopping the alarm from other alarm devices 10-2 to 10-5, stops the alarm sound indicating the interlocking source.

With this configuration, when interlocking alarm is made by two or more alarm devices 10-1 to 10-5 and an alarm stop processing is performed with the alarm stop switch 20 in any of the alarm devices 10-1 to 10-5, all the alarm outputs of the interlocking source and the interlocking destination can be stopped.

In interlocking source alarm stop processing unit 164, the interlocking source alarm output processing unit 60 outputs alarm sound indicating the interlocking source from the speaker 58 of the alarming unit 36 upon detection of a fire. At the same time the interlocking source alarm stop processing unit 164 executes a display of alarm of the interlocking source alarm with blinked or flashed the LED 22. However, if the alarm sound indicating the interlocking source from the speaker 58 is stopped in response to the stop processing of the alarm stop switch 20 or to reception of the event signal indicating alarm stop from other alarm devices, the display of alarm of the interlocking source with the LED 22 is not turned off. Thus, the user can recognize that the alarm device 10-1 is the interlocking source from the display of the LED 22 even after the alarm sound indicating the interlocking source stopped.

On the contrary, the interlocking destination alarm output processing unit 62, upon receiving event signals indicating fire alert from other alarm devices, outputs the alarm sound indicating the interlocking destination from the speaker 58. At the same time, in a stop process, when the display of alarm, indicating the interlocking destination, is executed with LED 22, the interlocking destination alarm stop processing unit 66 stops both the alarm sound from the speaker 58 and the display of alarm with the LED 22.

Thus, display of the LED 22 of the interlocking source alarm device is still turned on even after alarm sound of all the alarm devices stopped by the alarm stop processing. In this manner, the alarm sound stops, user can find the place of fire without being bothered by alarm sound and recognize the interlocking source alarm device easily from the display of the LED 22 of the alarm device at that time.

Figure 8:
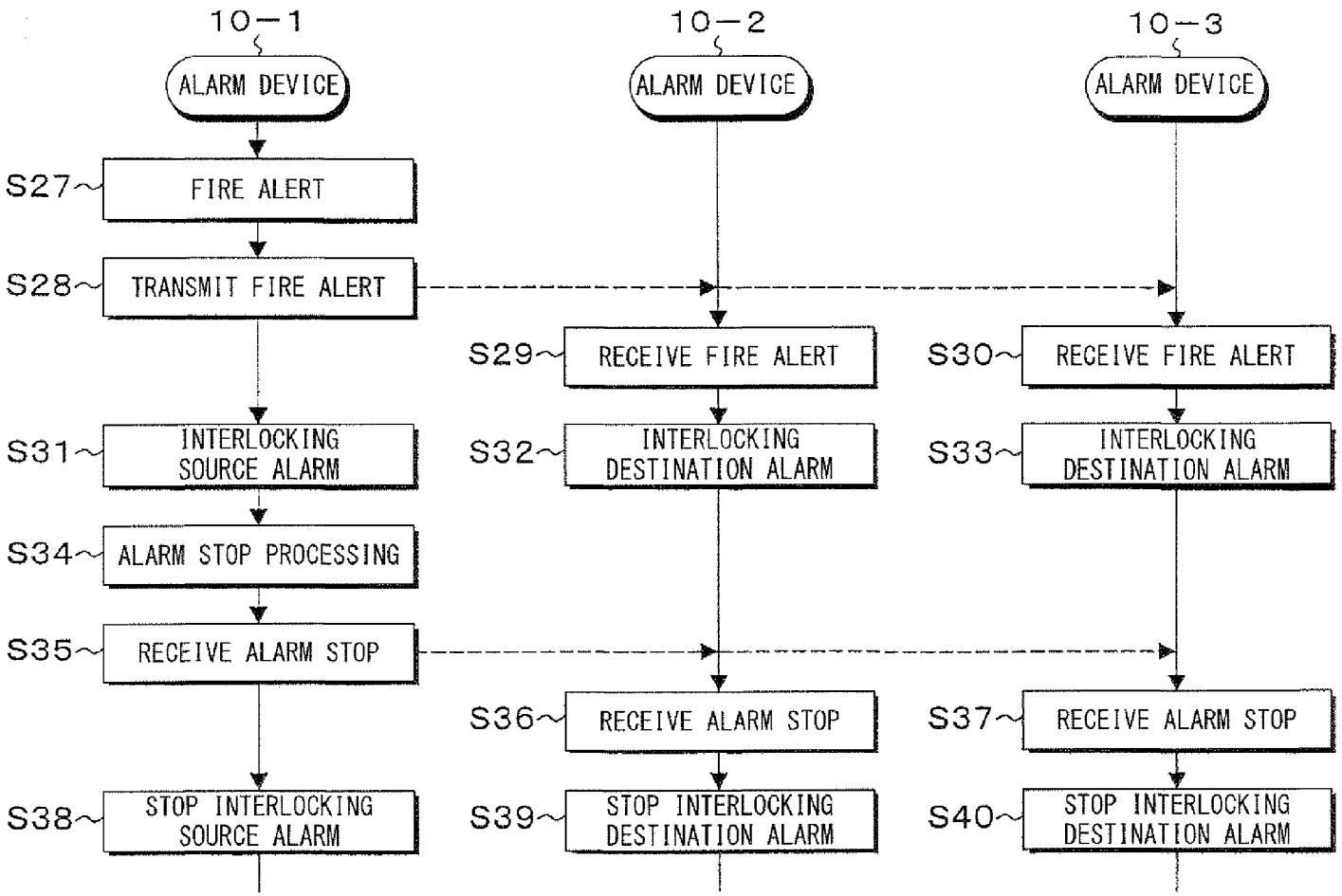
FIG. 8 is a time chart illustrating interlocking alarm and alarm stop according to the embodiment.

FIG. 8 is a time chart illustrating interlocking alarm and alarm stop according to the second embodiment of FIG. 7. Three alarm devices 10-1 to 10-3 are shown as examples.

In FIG. 8, upon detection of fire in the alarm device 10-1 and fire alert is detected in step S27, an event signal indicating fire alert is transmitted in step S28 and other alarm devices 10-2 and 10-3 receive the fire alert in steps S29 and S30, respectively.

The interlocking source alarm device 10-1 outputs alarm sound indicating the interlocking source in step S31. The interlocking destination alarm devices 10-2 and 10-3 output alarm sound indicating the interlocking destination in steps S32 and S33, respectively.

Next, in response to the alarm stop processing performed in the interlocking source alarm device 10-1 in step S34, the alarm device 10-1 transmits an event signal indicating alarm stop in step S35 and other alarm devices 10-2 and 10-3 receive the alarm stop in steps S36 and S37, respectively.

The interlocking source alarm device 10-1 then stops a interlocking source alarm sound in step S38. The interlocking destination alarm devices 10-2 and 10-3 stop interlocking destination alarm sound in step S39 and S40, respectively. In this manner, the alarm sound of all the alarm devices 10-1 to 10-3 is stopped simultaneously.

As described above, the display of alarm of the LED 22 of the interlocking source alarm device 10-1 of which the alarm sound has been stopped in step S38 is still turned on. Thus, the user can find the place of fire with the alarm sound already stopped and easily recognize that the alarm device 10-1 is the interlocking source alarm device from the display of the LED 22 of the alarm device 10-1.

Figure 9:
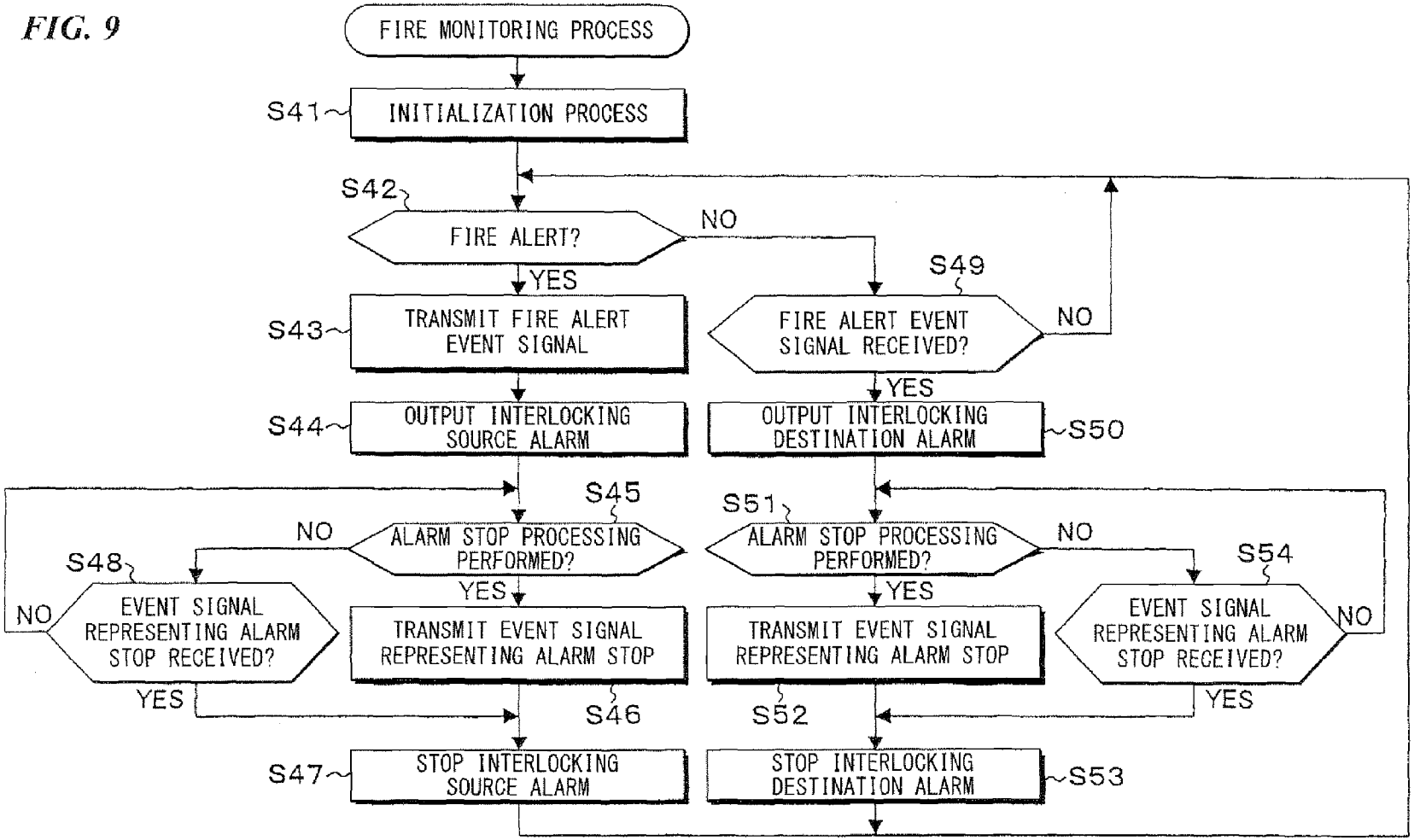
FIG. 9 is a flowchart illustrating a fire monitoring process according to the embodiment.

FIG. 9 is a flowchart illustrating a fire monitoring process according to the second embodiment of FIG. 7. The fire monitoring process is a process operation of the CPU 28.

In FIG. 9, an initialization process including group setting is performed in step S41. In step S42, existence of fire alert is being monitored. If fire alert is detected in step S42, the alarm device 10-1 transmits an event signal indicating fire alert in step S43. Next, alarm sound indicating the interlocking source is output in step S44. Next, in step S45, existence of an alarm stop processing is being monitored. If an alarm stop processing is performed, the process proceeds to step S46 where an event signal indicating alarm stop is transmitted and the alarm sound of the interlocking source is stopped in step S47.

On the contrary, if it is determined in step S45 that an alarm stop processing has not been performed, existence of reception of an event signal indicating alarm stop from other alarm devices is being monitored in step S48. If reception of the event signal is distinguished, the interlocking source alarm sound is stopped similarly in step S47.

If fire alert is not detected in step S42, existence of reception of an event signal indicating fire alert is being monitored in step S49. If reception of the event signal is distinguished, the interlocking destination alarm sound is output in step S50.

Next, if the alarm stop processing is distinguished in step S51, an event signal indicating alarm stop is transmitted to other alarm devices in step S52 and then interlocking destination alarm sound is stopped in step S53. If the alarm stop processing is not distinguished in step S51, reception of an event signal indicating alarm stop from other alarm devices is being checked in step S54. If an event signal indicating alarm stop is received, the interlocking destination alarm sound is stopped in step S53.

Figure 10:
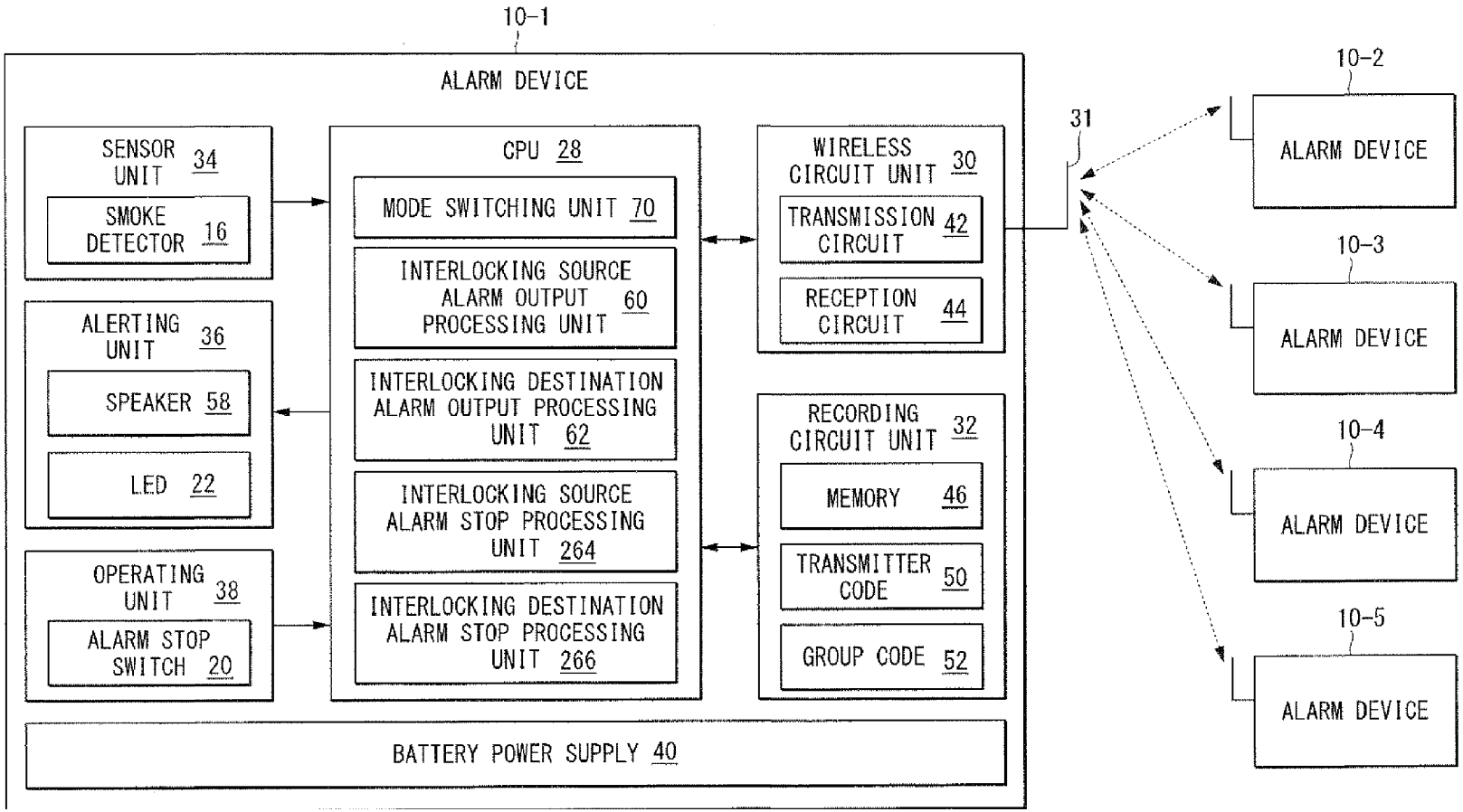
FIG. 10 is a block diagram illustrating a third embodiment of the alarm device according to the invention.

FIG. 10 is a block diagram illustrating a third embodiment of the alarm device according to the invention. The third embodiment is characterized in that the alarm stop according to the first embodiment of FIG. 3 and the alarm stop according to the second embodiment of FIG. 7 can be selected through mode switching.

In FIG. 10, as shown in an alarm device 10-1 of which circuit conFIGuration is shown in detail, the alarm device 10-1 includes a CPU 28, a wireless circuit unit 30, a recording circuit unit 32, a sensor unit 34, an alarming unit 36, an operating unit 38 and a battery power supply 40 as in the first embodiment of FIG. 3.

The CPU 28 includes a interlocking source alarm output processing unit 60 and a interlocking destination alarm output processing unit 62 which are the same as those in the first embodiment of FIG. 3. The CPU 28 also includes a mode switching unit 70, a interlocking source alarm stop processing unit 264 and a interlocking destination alarm stop processing unit 266 as functions inherent to the third embodiment.

The mode switching unit 70 switches an alarm stop mode between first and second modes.

The interlocking source alarm stop processing unit 264, upon detecting an operation of an alarm stop switch 20, while outputting the alarm sound indicating the interlocking source in the first switched mode, transmits an event signal indicating alarm stop to other alarm devices 10-2 to 10-5. More, the interlocking source alarm stop processing unit 264, upon detecting an operation of an alarm stop switch 20, while outputting the alarm sound indicating the interlocking source in the second switched mode, stops the alarm indicating the interlocking source and transmits the event signal indicating alarm stop to other alarm devices 10-2 to 10-5, stops the alarm sound.

The interlocking destination alarm stop processing unit 266 performs the same operation in both the first switched mode and second switched mode. That is, the interlocking destination alarm stop processing unit 266 which stops an output of the alarm indicating the interlocking destination and transmits the event signal for stopping the alarm to the other alarm device 10-2 to 10-5, stops the alarm sound, when an operation to the alarm stopping unit is detected while outputting the alarm indicating the interlocking destination in the first switched mode or the second switched mode.

The interlocking destination alarm stop processing unit 266 stops the alarm sound indicating the interlocking destination, when the event signal for stopping the alarm from either of other alarm device 10-2 to 10-5 is received, while outputting the alarm sound indicating the interlocking destination in either the first mode or the second mode.

With this conFIGuration, in the third embodiment of FIG. 10, when the first mode is set by the mode switching unit 70, an alarm stop process the same as that in the first embodiment shown in FIG. 3 is performed. In particular, a state is obtained in which only alarm sound of the interlocking source alarm device is output in response to the alarm stop processing. On the contrary, when the second mode is selected, alarm sound of all the alarm devices is stopped simultaneously as in the alarm process of the second embodiment of FIG. 7 and display of the LED of remains in the alarm device of the interlocking source.

Figure 11:
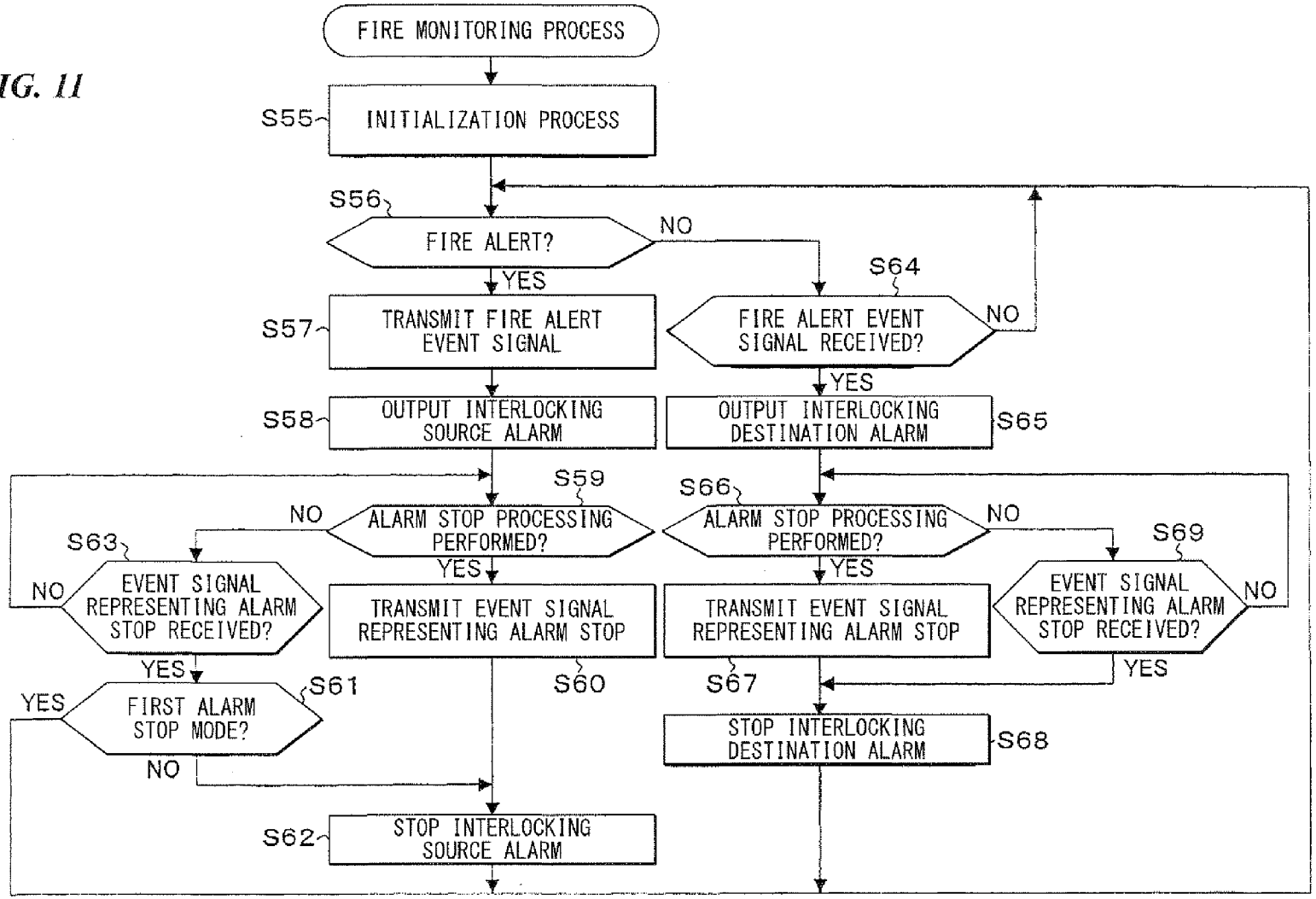
FIG. 11 is a flowchart illustrating a fire monitoring process according to the embodiment.

FIG. 11 is a flowchart illustrating a fire monitoring process in the third embodiment of FIG. 10. In FIG. 11, one of the first mode and second mode is selected as a mode for the alarm process by the mode switching unit 70 of FIG. 10 in the initialization process in step S55.

Next, if fire alert is detected during monitoring in step S56, an event signal indicating fire alert is transmitted to other alarm devices in step S57 and then interlocking source alarm sound is output in step S58. Next, if an alarm stop processing is detected in step S59, an event signal indicating alarm stop is transmitted to other alarm devices in step S60 to stop the alarm sound. The interlocking source alarm sound is stopped in step S62.

If alarm stop processing is not detected in step S59, reception of an event signal indicating alarm stop from other alarm devices is detected in step S63. When the event signal is received, whether the alarm stop is in the first mode or second mode is distinguished in step S61. If the alarm stop is in the first mode, stop of the interlocking source alarm sound in step S62 is skipped. If the alarm stop is in the second mode, the interlocking source alarm sound is stopped in step S62.

On the contrary, if fire alert is not detected in step S56, the process proceeds to step S64 where reception of the event signal indicating fire alert from other alarm devices is being monitored. When an event signal indicating fire alert is received, the process proceeds to step S65 where interlocking destination alarm sound is output. Next, when an alarm stop processing is detected in step S66, an event signal indicating alarm stop is transmitted to other alarm devices in step S67 and then interlocking destination alarm sound is stopped in step S68.

On the contrary, if there is no alarm stop processing in step S66, reception of an event signal indicating alarm stop from other alarm devices is being checked in step S69. When reception of the event signal is detected, the interlocking destination alarm sound is stopped in step S68. The alarm sound indicating the interlocking source and the alarm sound indicating the interlocking destination may be identical to each other. Alarm is not limited to sound and various alerting methods including light can be employed.

Although the foregoing embodiments have been described with reference to alarm devices for fire detection, the alarm stop process of the present embodiments can also be directly applied to other alarm devices for suitably detecting abnormal conditions, such as alarm devices for gas leak and security. The embodiments of the invention may also be applied to alarm device for various purposes, such as for buildings and offices.

Although the sensor unit and the alarm output processing unit are provided integrally in the alarm device in the foregoing embodiments, the sensor unit and the alarm output processing unit may be provided as separate parts in an alarm device as another embodiment.

Although wireless alarm devices are described in the foregoing embodiments, the alarm stop process may be applied directly to hard-wired alarm devices. The invention is not limited to the foregoing embodiments but includes variations without departing from its objects and advantages and is not limited by the numerical values presented in the foregoing embodiments.

INDUSTRIAL APPLICABILITY

An alarm device according to the invention is useful in an alarm device which detects and warns of an abnormal condition, such as a fire, and transmits signals to other alarm device for interlocking alarm output.

The invention claimed is:

1. An alarm device comprising;

a transmitting-and-receiving circuit unit which transmits and receives an event signal with other alarm device;

an alarm sound outputting unit which outputs alarm sound;

an alarm displaying unit which outputs a display of alarm;

an operating unit which includes an alarm stopping unit;

an interlocking source alarm output processing unit which, upon receiving abnormal-detection signal from a sensor unit which detects abnormality, outputs alarm sound and a display of alarm indicating an interlocking source, and transmits the event signal indicating the abnormality to the other alarm device of an interlocking destination;

an interlocking destination alarm output processing unit which, upon receiving event signal indicating the abnormality from the other alarm device, outputs alarm sound and a display of alarm indicating the interlocking destination;

an interlocking source alarm stop processing unit which, upon detecting an operation to the alarm stopping unit while outputting the alarm sound and the display of alarm indicating the interlocking source, stops an output of the alarm sound indicating the interlocking source and maintains the display of alarm indicating the interlocking source, transmits the event signal for stopping the alarm sound and the display of alarm to the other alarm device and stops an output of the alarm sound and the display of alarm indicating the interlocking destination; and an interlocking destination alarm stop processing unit which stops the output of the alarm sound and the display of alarm indicating the interlocking destination and transmits the event signal for stopping the output of the alarm sound and the display of the alarm to the other alarm device, when an operation to the alarm stopping unit is detected while outputting the alarm sound and the display of alarm indicating the interlocking destination, while which stops the output of the alarm sound and the display of alarm indicating the interlocking destination, when the event signal for stopping the output of the alarm sound and the display of alarm from the other alarm device is received, while outputting the alarm sound and the display of alarm indicating the interlocking destination, wherein:

the interlocking destination alarm stop processing unit stops the output of the alarm sound and the display of alarm indicating the interlocking destination, upon receiving abnormal-detection signal from the sensor unit while outputting the alarm sound and the display of alarm indicating the interlocking destination;

the interlocking source alarm output processing unit outputs alarm sound and a display of alarm indicating an interlocking source, and transmits the event signal indicating the abnormality to the other alarm device of an interlocking destination; and the interlocking source alarm stop processing unit stops the output of the alarm sound indicating the interlocking source, and transmits the event signal for stopping the alarm sound and the display of alarm to the other alarm device and stops the output of the alarm sound and the display of alarm indicating the interlocking destination, when the abnormal-detection signal from the sensor unit is stopped while outputting the alarm sound and the display of alarm indicating the interlocking source, and the interlocking source alarm output processing unit in the alarm device of an interlocking source transmits the event signal indicating the abnormality to the other alarm device of an interlocking destination after predetermined time, when the operation to the alarm stopping unit is detected in the other alarm device of an interlocking destination while the interlocking source alarm output processing unit in the alarm device of the interlocking source outputs the alarm sound and the display of alarm indicating the interlocking source, and the sensor unit in the alarm device of the interlocking source detects the abnormality.

2. The alarm device according to claim 1 wherein the interlocking source alarm stop processing unit stops the output of the alarm sound indicating the interlocking source and maintains the display of alarm indicating the interlocking source, upon receiving the event signal for stopping the output of the alarm sound and the display of alarm from the other alarm device, while outputting the alarm sound and the display of alarm indicating the interlocking source.

3. The alarm device according to claim 1 further comprising:

a mode switching unit which switches an alarm stopping mode either a first mode or a second mode, wherein the interlocking source alarm stop processing unit maintains outputting the alarm sound, upon receiving the event signal for stopping the output of the alarm sound from the other alarm device while outputting the alarm sound indicating the interlocking source in the first mode, while the interlocking source alarm stop processing unit stops the output of the alarm sound indicating the interlocking source, when the event signal for stopping the alarm sound from the other alarm device is received while outputting the alarm sound indicating the interlocking source in the second mode.

* * * * *